United States Patent [19]

Greenwald et al.

[11] 4,119,237

[45] Oct. 10, 1978

[54] ACCESS DOOR LOCKING MECHANISM FOR A COIN OPERATED APPARATUS

[75] Inventors: Harry Greenwald, Whitestone; Pierre Lier, Wantagh, both of N.Y.

[73] Assignee: Walter Kidde & Company, Inc., Clifton, N.J.

[21] Appl. No.: 727,259

[22] Filed: Sep. 27, 1976

[51] Int. Cl.[2] ..... B65D 87/18

[52] U.S. Cl. ..... 220/210; 70/164

[58] Field of Search ..... 70/158, 163, 164, 166, 70/167, 168, 169; 220/210

[56] References Cited

U.S. PATENT DOCUMENTS

| | | | |
|---|---|---|---|
| 1,662,482 | 3/1928 | Ward | 220/210 |
| 2,081,055 | 5/1937 | Kiracofe | 70/166 |
| 2,762,216 | 9/1956 | Wasson | 70/163 |
| 4,000,632 | 1/1977 | Summan | 220/210 |

*Primary Examiner*—Ro E. Hart

*Attorney, Agent, or Firm*—McAulay, Fields, Fisher & Goldstein

[57] ABSTRACT

An access door locking mechanism for a coin operated apparatus wherein the housing for the apparatus is formed having an opening in a wall portion to provide access to said apparatus. A door is mounted on the housing and is disposed for movement from a releasable position to a secured position relative to the housing wall opening. The door and the housing are each provided with members adapted to interengage upon movement of the door to its secured position for retaining the door in place. The door and housing are further provided with complementary interfitting portions for making the outer surface of the door flush with the outer surface of the housing when the door is in its secured position. The door is further provided with an outwardly projecting irregular shaped portion adapted to receive a wrench having a complementary irregular shaped opening for selectively moving the door between its releasable and secured positions. The mechanism further includes key operated locking means mounted on the housing and having a blocking bar disposed for movement, upon operation of the locking means, to engage with a bracket mounted on the door to prevent movement of the door from its secured position to its releasable position.

10 Claims, 4 Drawing Figures

ACCESS DOOR LOCKING MECHANISM FOR A COIN OPERATED APPARATUS

BACKGROUND OF THE INVENTION

1. Field of the Invention

This invention relates generally to a coin operated apparatus, and more particularly, to an access door locking mechanism for the housing of said apparatus to substantially reduce the likelihood of persons gaining unauthorized access to said apparatus.

2. Description of the Prior Art

Coin controlled or operated units are usually installed on commercial appliances; such as, clothes washers, dryers, vending machines and the like. The coin control is enclosed within a housing mounted on the appliance or machine, and the housing is usually provided with a locked coin drawer assembly which is intended to prevent unauthorized access to a coin receptacle or box removably supported within the housing. In certain constructions of the coin operated apparatus, such as disclosed in U.S. Pat. No. 3,559,877 entitled Internal Collection System for a Coin Operated System and dated Feb. 2, 1971, the coin box is secured in position by means of an internal locking mechanism which is accessible only through a service door removably mounted on a wall of the housing.

The coin controlled or operated apparatus comprises a guide track mounted on the housing, and a coin slide reciprocally supported in the guide track for projected and retracted movement. The coin slide has one or more coin receiving portions whereby insertion of the proper sum of coins therein permits projected movement of the coin slide within the housing to operate the appliance. In this regard, the inner end of the coin slide includes an actuator adapted to engage with a switch mechanism upon projected movement of the coin slide to its operate position; whereby movement of said switch is operable to connect the appliance in circuit with a source of energy for initiating the operating cycle of the appliance.

The coin operated machines described above are disposed for public use and are for the most part left unattended. Therefore, by the very nature of their use, such coin operated machines are vulnerable to acts of vandalism and burglary. Heretofore, experience has shown that unauthorized access to the coin box of such coin operated machines or the components of such apparatus was had by forcing or destroying the locks on the service door or on the coin box drawer, either by drilling or hammering. Because of the locks on the machines are generally exposed, a would-be thief has easy access thereto and therefore can readily apply the tools of this trade to force the locks. With the locks thus incapacitated, the thief then has easy access to the coin box or the components of such apparatus. Consequently, thousands of dollars each year are lost as the result of acts of vandalism and burglary.

The present invention provides a novel access door locking mechanism to deter unauthorized access to the apparatus, and provide a virtually theft and tamper proof locking system for the access door.

SUMMARY OF THE INVENTION

The access door locking mechanism of the present invention is adapted to serve as a closure for an access opening provided in a wall portion of the housing. The door is mounted on the housing wall portion and is disposed for movement from a releasable position to a secured position relative to the housing wall opening.

The door and housing wall portion are each provided with members adapted to interengage upon movement of the door to its secured position. More specificallly, the housing wall portion is provided with a plurality of spaced lug members projecting inwardly of the housing wall opening in a plane substantially parallel and offset to the plane of the wall. The door is provided with a plurality of tab members, equal in number to the housing wall lug members, mounted on the inner surface of the door. Each one of the tab members has a portion extending in a plane substantially parallel and offset to the plane of the door to define a space between the offset tab portion and the inner surface of the door which is slightly less than the thickness of each one of the lug members. The arrangement is such that each one of the spaces between the offset tab portions and the inner surface of the door frictionally receives and engages with a separate one of the lug members upon movement of the door to its secured position for retaining the door in place.

The door and housing wall portion are further provided with complementary interfitting portions for making the outer surface of the door flush with the outer surface of the housing when the door is in its secured position. The door is further provided with an outwardly projecting ovoid shaped portion adapted to receive a wrench having a complementary shaped opening for selectively moving the door between its releasable and secured positions.

The mechanism further includes key operated locking means mounted on the housing wall portion to prevent movement of the door from its secured position to its releasable position. In this regard, the door is provided with a bracket having a portion projecting inwardly of the housing. The locking means is provided with a blocking bar disposed for movement, upon operation of the locking means, to engage with the projecting portion of the bracket to prevent movement of the door to its releasable position.

Accordingly, an object of the present invention is to provide a novel access door locking mechanism for a coin operated apparatus wherein the door is mounted to the housing of said apparatus in tight fitting relation, and where the door is formed having a raised irregular shaped portion adapted to receive a special wrench for selectively moving the door between releasable and secured positions relative to said housing.

The above and other objects, features and advantages of the present invention will become more apparent from a consideration of the following detailed description when taken in conjunction with the accompanying drawings.

DESCRIPTION OF THE PREFERRED EMBODIMENT

Figure 1:
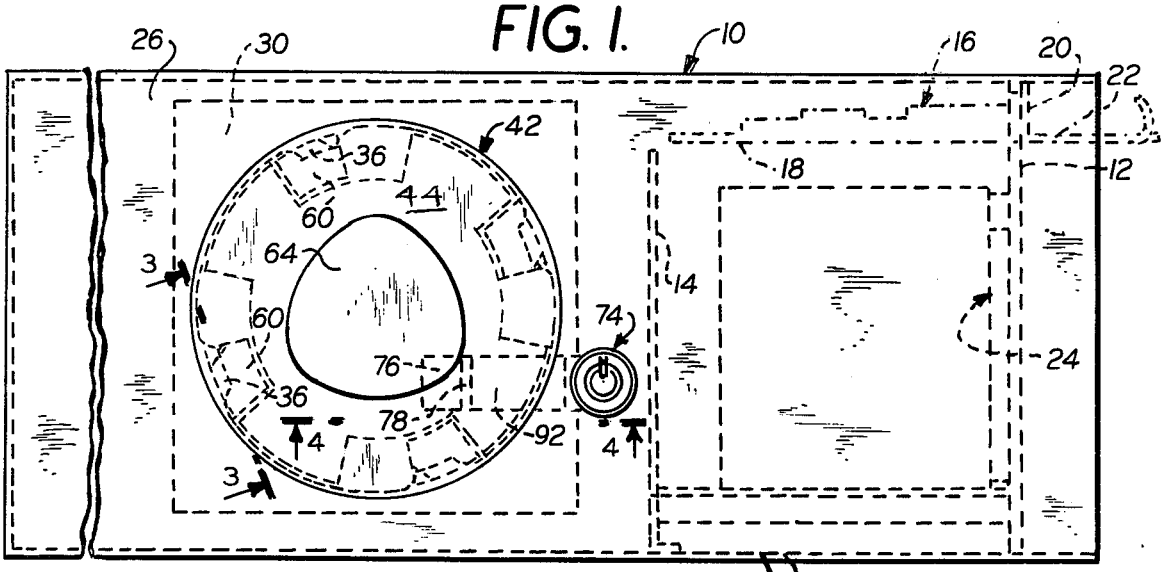
FIG. 1 is a side elevational view of the access door locking mechanism constructed in accordance with the present invention, with the door being mounted on the housing of a coin operated apparatus and moved to a secured position relative to said housing.

Referring to the drawings, numeral 10 represents a housing for a coin operated apparatus which is adapted to be installed on a commercial appliance, such as, a clothes washer, dryer, vending machine or the like. Housing 10 is formed having a front wall 12 and an internal member 14, such as a partition or brace, in spaced preset parallel relation to wall 12. The upper surface portion of front wall 12 is illustrated as supporting a coin slide assembly 16 which includes a guide track 18 having an integrally formed faceplate 20 mounted to the front wall of the housing in conventional manner. Guide track 18 reciprocally supports a coin slide 22 for projected and retracted movement thereof. Coin slide 22 is formed having a coin receiving portion wherein the presence of one or more coins in the coin receiving portion permits projected movement of the coin slide 22 to its operate position within the housing. Such movement of the coin slide causes the inner end thereof to engage with a switch mechanism (not shown) which serves to connect the appliance in circuit with a power source for initiating the operating cycle of the appliance.

A coin box assembly 24 is removably supported within housing 10 through an opening in the lower surface portion of front wall 12. The assembly usually includes a faceplate formed integrally with the coin box and a tumbler-type lock mounted in the faceplate by which the coin box assembly 24 is latched or locked to the front wall of the housing. Upon projected movement of coin slide 22, the coins are discharged through an opening in the undersurface of guide track 18 and are directed by means of a funnel (not shown) to the coin box located therebelow. The aforesaid structure is well known in the art and is thus not illustrated in detail as it forms no part of the present invention.

Figure 2:
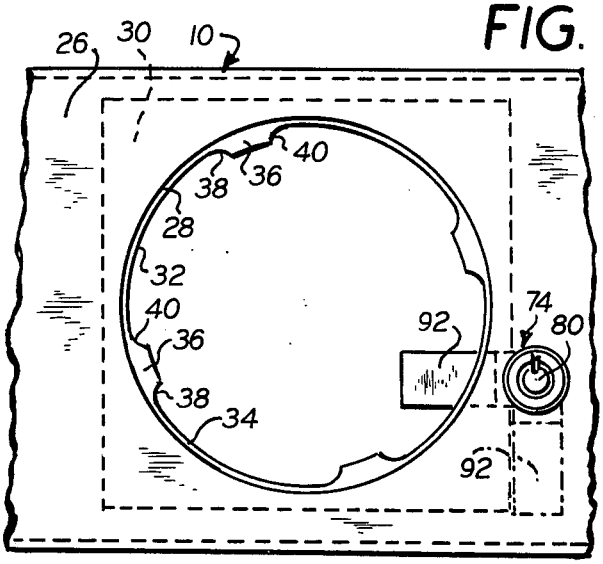
FIG. 2 is an exploded view of the component parts of said locking mechanism, and includes: a portion of the housing wall having an access opening, a closure member for said housing wall opening illustrating the inner surface of said member, a special tool adapted to engage with said closure member for selectively moving said member between releasable and secured positions relative to said housing, and a key adapted to engage with locking means on said housing wall portion wherein the locking means is operable to prevent movement of the closure member from its secured position to its releasable position.
Figure 2:
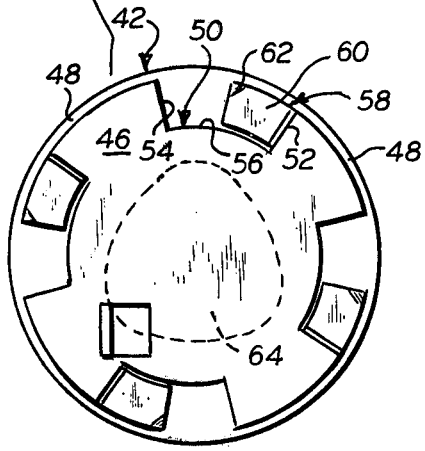
Figure 2:
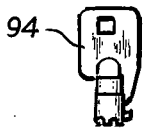
Figure 2:
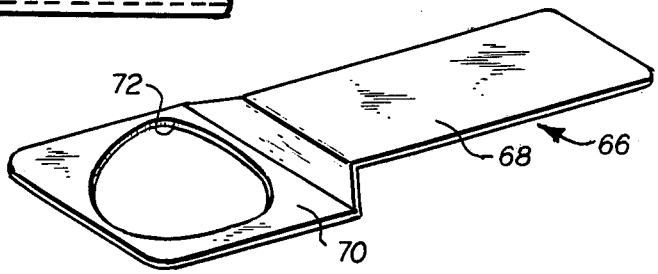
Figure 3:
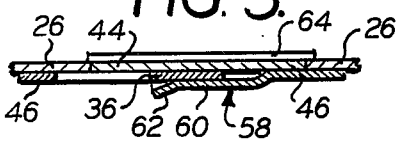
FIG. 3 is a sectional view taken through line 3—3 of FIG. 1.

Housing 10 is constructed with a side wall 26 formed having an opening 28 therein located to permit access to the coin operated apparatus or the component parts thereof. Referring to FIG. 2, access opening 28 is preferably circular in shape. A support plate 30 is fixedly mounted on the inner surface of housing wall 26, by means of welding or the like, in the region overlying housing wall opening 28. Plate 30 is also formed having a generally circular opening 32 which is aligned with wall opening 28 to permit access to the interior of the housing. The diameter of plate opening 32 is slightly less than the diameter of wall opening 28 to define a surface 34 extending along the perimeter of plate 30 for supporting a closure member in the manner hereinafter described. Plate 30 is constructed having a plurality of integrally formed lug members 36 projecting inwardly of plate opening 32 in the plane of said plate. In the preferred embodiment, the construction provides for four such inwardly projecting lugs 36 spaced equally around the perimeter of plate opening 32. The side edges of each one of the projecting lugs 36 are undercut to form arcurately shaped edges 38, 40 which merge smoothly with the perimeter of the plate. The arrangement is such that lugs 36 similarly project inwardly of the housing wall opening 28, but in a plane substantially parallel and offset to the plane of wall 26.

A closure, represented generally by numeral 42, is provided for the housing wall opening 28 and support plate opening 32. Referring to FIGS. 1 and 2, the closure represents a circular shaped door constructed having an outer plate 44 and an inner backing plate 46 fixedly connected together such as by welding, cementing, or the like. The diameter of backing plate 46 is slightly less than that the diameter of outer plate 44 to define a surface 48 extending along the inner perimeter of plate 44 which is adapted to abut against the support plate surface 34 when door 42 is mounted to housing wall 26. In this regard, the diameter of outer plate 44 is slightly less than the diameter of housing wall opening 28, and the diameter of backing plate 46 is slightly less than the diameter of support plate opening 32. The dimensional tolerances are such that when door 42 is mounted on the support plate surface 34 of housing wall 26, there is a tight edge-to-edge interfit while still permitting rotational movement of door 42 relative to housing wall 26 in the manner hereinafter described.

Backing plate 46 is constructed having a plurality of open cut-out segments 50 spaced around the perimeter of the plate, with each one of the segments being defined by side edges 52, 54 and a bottom edge 56. The side edges 52, 54 of each segment are designed to extend radially inwardly from the circumference of the plate 46 whereas the bottom edge 56 extends arcuately of said plate. A separate tab member, represented generally by numeral 58, is joined to plate 46 along each segment side edge 52 to represent an internally formed continuation of said plate. Each one of the tab members 58 is formed having a portion 60 extending in a plane substantially parallel and offset to the plane of backing plate 46. Each offset portion 60 also projects arcuately of plate 46 in a direction generally toward the other segment side edge 54, and terminates short of said other side edge to provide an opening or space for receiving therein a separate one of the lug members 36 when door 42 is mounted to housing wall 26. The structure and placement of each one of the tab portions 60 is such to define a space between of said portions and the inner surface of door plate 44, which space is slightly less than the thickness of the housing wall lug members 36. The arrangement is such that each one of said spaces frictionally receives and engages with a separate one of said lug members in the manner hereinafter defined. To facilitate entry of said lug members in the spaces between the offset tab portions and the inner surface of door plate 44, each one of the tab portions 60 terminates in an outwardly bent edge portion 62 which is spaced from the inner surface of door plate 44 by a distance greater than the thickness of the housing wall lug members 36.

Door 42 is further constructed having an irregular or ovoid shaped portion 64 projecting outwardly from the outer surface of plate 44. In the preferred embodiment as illustrated in FIG. 1, the ovoid portion is constructed having three cam shaped lobe portions which are suitably sized to present surfaces that are difficult to grip. It thus becomes necessary to utilize a special tool or wrench for securing door 42 to housing wall 26.

Referring to FIG. 2, the special tool or wrench is represented by numeral 66 which is formed having a handle portion 68 and an offset working portion 70. The offset portion 70 is further formed having an irregular shaped opening 72 complementary in shape to the raised ovoid shaped portion 64 of door 42. The arrangement is such that only those persons having access to wrench 66 will be able to secure door 42 to the housing. It thus follows that without possession of wrench 66, a would-be thief would not be able to remove door 42 from the housing, and would thus be prevented from gaining unauthorized access to the coin operated apparatus and the components thereof located within the housing.

In operation, door 42 is mounted on housing wall 26 with the inner surface 48 of plate 44 abutting against the support plate surface 34 of side wall opening 28. In this regard, it will be appreciated that door 42 is positioned or oriented in place such that a separate one of the lug members 36 is received in each one of the spaces defined by the cut-out segments 50 of backing plate 46. In other words, the four lug members 36 of support plate 30 clear the mating cut-outs 50 of backing plate 50 to permit door 42 to be freely mounted to and removed from housing wall 26. The mounting arrangement as described above is defined as the releasable position of door 42.

Door 42 is now in condition to be moved by means of wrench 66 to secured position relative to housing wall opening 28. In this regard, wrench 66 is positioned with the raised ovoid shaped portion 64 of door 42 being received within the accommodating opening 72 of wrench 66. The door is thus disposed for rotational movement from a releasable position to a secured position whereby the lug members 36 of support plate 30 interengage with the offset tab portions 60 of door backing plate 46 to retain door 42 in its secured position.

More specifically, door 42 is rotated clockwise so that a separate one of the lug members 36 is frictionally received in each one of the spaces between the offset tab portions 60 and the inner surface of door plate 44. Because of the dimensional tolerance of the engaging members, there is a binding or wedging action which serves to draw the door inwardly in tight edge-to-edge interfitting relation with housing wall 26. Furthermore, the dimensions are such that the marginal edge portions of door 42, housing wall opening 28 and support plate opening 32 define complementary interfitting portions for making the outer surface of door plate 44 flush with the outer surface of housing wall 26 when door 42 is in its secured position.

As previously indicated, the tab portions 60 each have outwardly bent edge portions 62 to facilitate engagement of lug members 36 with tab portions 60 upon rotational movement of door 42 to its secured position. Furthermore, the ovoid shaped portion 64 of door 42 is sized to project outwardly beyond the outer surface of housing wall 26 when door 42 is mounted to the housing to facilitate engagement of said ovoid shaped portion with wrench 66 for selectively moving door 42 between its releasable and secured positions.

Figure 4:
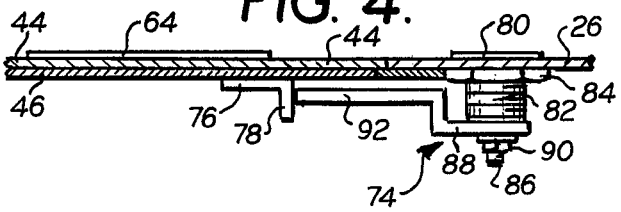
FIG. 4 is a sectional view taken through line 4—4 of FIG. 1.

As an extra safety precaution, key operated lock means, represented generally by numeral 74, are provided to prevent rotational movement of door 42 from its secured position to its releasable position except by authorized persons. Referring to FIGS. 1, 2, and 4, bracket 76 is fixedly mounted to the backing plate 46 of door 42, by means of welding or the like, so as to be disposed for conjoint movement with said plate. Bracket 76 includes a portion 78 projecting inwardly of the housing in a plane perpendicular to the plane of the plate.

Lock means 74 includes a key receiving portion 80 accessible from outside of housing wall 26, and an operatively connected lock portion 82 which passes through an accommodating opening in said wall. Lock portion 82 is externally threaded for receiving a lock nut 84 which serves to secure lock means 74 to housing wall 26. Lock portion 82 terminates in a threaded shaft 86 to which is mounted a blocking bar 88 by means of combined lock nut and washer 90. Blocking bar 88 is connected for conjoining rotational movement with lock portion 82, and includes an offset portion 92 extending in a plane substantially parallel and offset to the plane of support plate 30. The arrangement is such that blocking bar is disposed for movement from a first position, represented by the phantom line drawing in FIG. 2, to a second position, represented by the solid line drawing in said FIG. 2 for engaging with bracket 76 as hereinafter described.

In operation, a key 94 is inserted into key receiving portion 80 of lock means 74 and turned in one direction thereby rotating lock portion 82 and the blocking bar 88 secured thereto. Rotation of lock means 74 in said one direction serves to rotate blocking bar 88 from its first position wherein offset bar portion 92 is clear of the door bracket 76, to its second position, wherein said bar portion 92 is positioned in the path of movement of said bracket 76 for engaging with the projecting portion 78 of said bracket to prevent movement of door 42 to its releasable position.

It will be appreciated that although door 42 can be mounted to housing wall 26 in any one of four angularly oriented positions, the effective operation of lock means 74 requires that the door be selectively positioned in the one correct orientation to permit engagement of blocking bar 88 with the door bracket 76. This is readily achieved by mounting door 42 with its bracket 76 aimed or laterally aligned with lock means 74, as viewed in FIG. 1.

There is thus provided a unique access door locking mechanism wherein the door 42 is constructed without the conventional knob or handle. The door 42 is mounted in tight fitting relation to the housing 10 by means of the wedging action produced upon engagement of the housing wall lugs 36 with the door tabs 58. The elimination of a door handle, together with the tight fitting mounting arrangement of the door, serves to reduce attempts of theft and vandalism directed at the coin operated apparatus. In order to secure or remove the door from the housing, a special wrench-like tool is required to effect selective rotation of the door between its releasable and secured position. A locking mechanism is also provided to prevent unauthorized rotation of the door from its secured position to its releasable position.

While a preferred embodiment of the invention has been shown and described in detail, it will be readily understood and appeciated that various changes or modifications thereof may be made without departing from the spirit and scope of the invention as set forth in the appended claims.

We claim:

1. An access door locking mechanism for a coin operated apparatus comprising:

(a) a housing adapted to receive therein portions of a coin operated apparatus, said housing having a wall portion formed with an opening to permit access to said apparatus;

(b) closure means for the opening in said housing wall portion, said closure means being disposed for movement from a releasable position to a secured position relative to said housing wall opening;

(c) engaging means on said closure means and said housing wall portion adapted to interengage upon movement of said closure means to its secured position for retaining said closure means in said secured position, said engaging means adapted to disengage upon movement of said closure means to its releasable position for removing said closure means from said housing wall portion;

(d) the marginal edge portions of said closure means and of the housing wall portion defining said opening having complementary interfitting portions for making the outer surface of said closure means flush with the outer surface of said housing wall portion when said closure means is in its secured position; and (e) said closure means having an irregular shaped portion projecting outwardly from its outer surface and beyond the outer surface of said housing wall portion when said closure means is mounted to said housing, said irregular shaped closure portion adapted to receive a wrench having a complementary irregular shaped opening for moving said closure means to selectively engage and disengage said engaging means.

2. The access door locking mechanism as recited in claim 1, wherein said irregular shaped closure portion is ovoid in shape having three cam shaped lobe portions.

3. The access door locking mechanisms as recited in claim 1, wherein said engaging means comprises a plurality of spaced lug members mounted on said housing wall portion and projecting inwardly of said housing wall opening in a plane substantially parallel and offset to the plane of said wall; said engaging means further comprising a plurality of tab members mounted on the inner surface of said closure means, each one of said tab members having a portion extending in a plane substantially parallel and offset to the plane of the inner surface of said closure means; the space between said offset tab portions and the inner surface of said closure means being slightly less than the thickness of said housing wall lug members; said lug members and said tab members being located such that each one of the said spaces between said tab portions and the inner surface of said closure means frictionally receives and engages with a separate one of said lug members upon movement of said closure means to its secured position.

4. The access door locking mechanism as recited in claim 3, wherein each one of said offset tab portions terminates in an outwardly bent edge portion spaced from the inner surface of said closure means by a distance greater than the thickness of each one of said housing wall lug members to facilitate entry of said lug members in the spaces between said offset tab portions and the inner surface of said closure means upon movement of said closure means to its secured position.

5. The access door locking mechanism as recited in claim 3, wherein said engaging means further comprises a support plate mounted on the inner surface of said housing wall portion and overlying said housing wall opening; said plate having and opening therein aligned with the opening in said housing wall portion to permit access to the apparatus in said housing; the dimensions of said plate opening being slightly less than the corresponding dimensions of said housing wall opening to provide said plate with a supporting surface for said closure means, said supporting surface extending along the perimeter of said plate; and said lug members being formed integrally with said plate and projecting inwardly of said housing wall opening in the plane of said plate.

6. The access door locking mechanism as recited in claim 5, wherein said engaging means further comprises a backing plate mounted on the inner surface of said closure means; the dimensions of said backing plate being slightly less than the corresponding dimensions of said support plate opening to permit said backing plate to be received within said opening when said closure means is mounted on the supporting surface of said support plate in its releasable position; and said tab members being formed integrally with said backing plate with their respective tab portions extending in a plane substantially parallel and offset to the plane of said plate.

7. The access door locking mechanism as recited in claim 6, wherein said housing wall opening and its associated support plate opening are each circular in shape, and said closure means and its associated backing plate are also each circular in shape with the diameter of said backing plate being slightly less than the diameter of said closure means; said backing plate having a plurality of open cut-out segments spaced around the perimeter of said plate, each one of said segments being defined by side edges and a bottom edge; a separate one of said tab members being joined to said backing plate along one of the side edges of each segment and representing a continuation of said plate; the offset tab portion of each tab member projecting in a direction generally toward the other one of said side edges of the associated segment and terminating short of said other side edge to provide an open portion of each said segment for receiving therein a separate one of said lug members when said closure means is mounted in its releasable position, and said lug members engaging with said offset tab portions upon rotational movement of said closure means to its secured position.

8. The access door locking mechanism as recited in claim 7, wherein the side edges of each one of said segments extend radially inwardly from the circumference of said plate and the bottom edge of each segment extends arcurately of said plate; and wherein the offset tab portions of said tab members also project arcuately of said plate.

9. The access door locking mechanism as recited in claim 1, wherein said closure means further comprises a bracket mounted on the inner surface thereof; said bracket disposed for conjoint movement with said closure means and having a portion projecting inwardly of said housing; said mechanism further comprising locking means mounted on said housing wall portion to prevent movement of said closure means from its secured position to its releasable position; said locking means having a key receiving portion accessible from outside of said housing and a connected lock shaft extending into said housing; said lock shaft being rotatable by a key inserted in said key receiving portion, said locking means further comprising a blocking bar connected to said lock shaft for rotation therewith; said blocking bar being disposed for movement from a first position wherein said bar is clear of said closure bracket to a second position wherein said bar is positioned in the path of movement of said closure bracket for engagement with the projecting portion of said bracket to prevent movement of said closure means to its releasable position.

10. An access door locking mechanism for a coin operated apparatus comprising:

(a) a housing adapted to receive therein portions of a coin operated apparatus, said housing having a wall portion formed with an opening to permit access to said apparatus;

(b) a plurality of spaced lug members mounted on said housing wall portion and projecting inwardly of said housing wall opening in a plane substantially parallel and offset to the plane of said wall;

(c) closure means for the opening in said housing wall portion, said closure means being disposed for movement from a releasable position to a secured position relative to said housing wall opening;

(d) a plurality of tab members mounted on the inner surface of said closure means, each one of said tab members having a portion extending in a plane substantially parallel and offset to the plane of the inner surface of said closure means, the space between said offset tab portions and the inner surface of said closure means being slightly less than the thickness of said housing wall lug members;

(e) said lug members and said tab members being located such that each one of the said spaces between said tab portions and the inner surface of said closure means frictionally receives and engages with a separate one of said lug members upon movement of said closure means to its secured position.

(f) the marginal edge portions of said closure means and of the housing wall portion defining said opening having complementary interfitting portions for making the outer surface of said closure means flush with the outer surface of said housing wall portion when said closure means is in its secured position;

(g) said closure means having an ovoid shaped portion projecting outwardly from its outer surface and beyond the outer surface of said housing wall portion when said closure means is mounted to said housing, said ovoid shaped closure portion adapted to receive a wrench having a complementary shaped opening for selectively moving said closure means between its releasable and secured positions;

(h) a bracket mounted on said closure means and disposed for conjoint movement therewith, said bracket projecting inwardly of said housing; and (i) key operated locking means mounted on said housing wall portion, said means comprising a blocking bar positioned within said housing and disposed for movement upon operation of said locking means from a first position wherein said bar is clear of said closure bracket to a second position wherein said bar is positioned in the path of movement of said bracket for engagement therewith to prevent movement of said closure means to its releasable position.

* * * * *